United States Patent [19]

Downer

[11] Patent Number: 4,475,262

[45] Date of Patent: Oct. 9, 1984

[54] PUSH TYPE CURLING BROOM

[76] Inventor: Eric D. Downer, 116 Purvis Crescent, Scarborough, Ontario, Canada, M1B 1M9

[21] Appl. No.: 367,548

[22] Filed: Apr. 12, 1982

[30] Foreign Application Priority Data

Nov. 19, 1981 [CA] Canada ..... 390406

[51] Int. Cl.[3] ..... A46B 15/00; A63B 67/14

[52] U.S. Cl. ..... 15/210 R; 15/144 A; 15/231

[58] Field of Search ..... 15/160, 144 A, 210 R, 15/229 AC, 231, 232, 233, 230.19

[56] References Cited

U.S. PATENT DOCUMENTS

| | | | |
|---|---|---|---|
| 1,989,921 | 2/1935 | Goodard | 15/144 A X |
| 2,764,774 | 10/1956 | Belsky et al. | 15/144 A X |
| 2,875,460 | 3/1959 | Legge | 15/144 A X |
| 2,899,225 | 8/1959 | Birr | 15/144 A X |
| 2,919,457 | 11/1960 | Cole | 15/231 |
| 3,099,855 | 8/1959 | Nash | 15/231 |
| 4,225,998 | 10/1980 | Thielen | 15/231 |

FOREIGN PATENT DOCUMENTS

| | | | |
|---|---|---|---|
| 926785 | 4/1947 | France | 15/231 |
| 17732 | 8/1927 | Netherlands | 15/231 |

*Primary Examiner*—Peter Feldman

[57] ABSTRACT

The invention relates to the game of curling, which is played on an ice surface, and more particularly to a curling broom of the push-type having a handle joined to the sweeping head by means of a swivelling joint, whereby the handle automatically adjusts to the height of the user while leaving the sweeping surface of the broom parallel to the ice surface. The sweeping surface of the broom may be of either the bristle or fabric type. The sweeping head is preferably symmetrical in contour, i.e. circular, square or hexagonal etc.

3 Claims, 3 Drawing Figures

PUSH TYPE CURLING BROOM

BACKGROUND OF THE INVENTION

This invention relates to the game of ice-curling wherein curling brooms or brushes are used to improve the surface of the ice ahead and in the slide path of a rock thrown by a player. Although the term "thrown" is used in respect of curling rocks the rocks are, in reality pushed by a player to start them in the correct direction down the ice. The improvement in the ice achieved by the sweeping action resides in both clearing of debris from the slide path as well as providing lower friction to the rock by producing, by broom or brush friction, a thin film of water on the ice.

Corn brooms, especially made for curling, are prone to loose straws and in order to overcome this problem socks, such as of nylon cloth, are now employed to prevent this and the corn straw has been replaced, in the sock, by plastic slats which provide a similar effect. Brushes or push-brooms are becoming popular but suffer also from a disadvantage, similar to the corn broom, in that they loose bristles which become embedded in the ice or caught under a sliding rock causing an unpredictable slide path. In order to overcome this problem it is known from Canadian Pat. No. 1,009,862—issued Apr. 28, 1981 to Albert N. Thompson to apply a fabric covering to the push-broom surface, in this instance two conjugate areas of different fabrics which can be brought into play by tilting the broom one way or the other.

Push brooms, as presently known, are subject to certain disadvantages:

(a) The sweeping or brushing surface is of elongated rectangular shape and in order for sweeping to be the most effective the broom must be oriented transverse to the slide path of a thrown rock thus necessitating a particular position of the sweeper with respect to the slide path.

(b) The handle of the broom is fixed to the broom head per se rendering it primarily best suited for use by a person of a predetermined height whereas curling persons are of various heights.

(c) The sweeper must note the orientation of the broom or head before contacting the ice in order to not touch (burn) the sliding (in play) rock. This orientation is not discernible from the handle of the broom which is round and provides no indication of head orientation.

(d) Brooms and brushes are subject to wear and must be discarded even though the parts thereof, which do not contact the ice, are still in good condition.

OBJECTS OF THE INVENTION

It is therefore and object of the present invention to provide a push broom which overcomes the defects and disadvantages of known brooms and brushes in that the angle of the push broom handle, with respect to the sweeping head, is freely movable and adjusts automatically to the height of the user. This adjustment is facilitated by an articulatable joint between the handle and the broom head.

It is a still further object of the invention to provide a push broom which ensures that the head thereof is always properly oriented with respect to the surface of the slide path and the sweeping surface is fully effective.

It is a further object of this invention to provide a push broom which allows a sweeper a choice of positions, with respect to the slide path, from which to sweep effectively.

It is a still further object of the invention to provide a push broom with a replaceable sweeping surface which may be either of the bristle or the fabric type although the bristle type may still be subject to loosing bristles but preffered by some sweepers.

SUMMARY OF THE INVENTION

In accordance with the present invention there is provided a curling broom of the push type which utilizes a handle attached to the broom head per se by an articulatable joint, for instance, a swivelling or universal joint. Such type handle connections are known from United States Pat. No. 2,711,059—R. G. Ames—issued June 21, 1955 and used in a wall sanding device. Further in accordance with the invention and in combination with the swivelling handle joint there is provided a sweeping head, preferrably symmetrical, for instance circular in contour, which head is provided with a, preferrable detachable, sweeping surface utilizing bristles or fabric.

In accordance with the invention the swivel joint of the handle with the sweeping head is preferrably free enough so that gravity, i.e. the weight of the head per se, will ensure that the sweeping surface tends to always orient itself parallel to the ice surface regardless of the handle with respect thereto.

BRIEF DESCRIPTION OF THE DRAWINGS

The invention will now be described with reference to the figures of the drawing in which.

DESCRIPTION OF THE PREFERRED EMBODIMENTS

Figure 1:
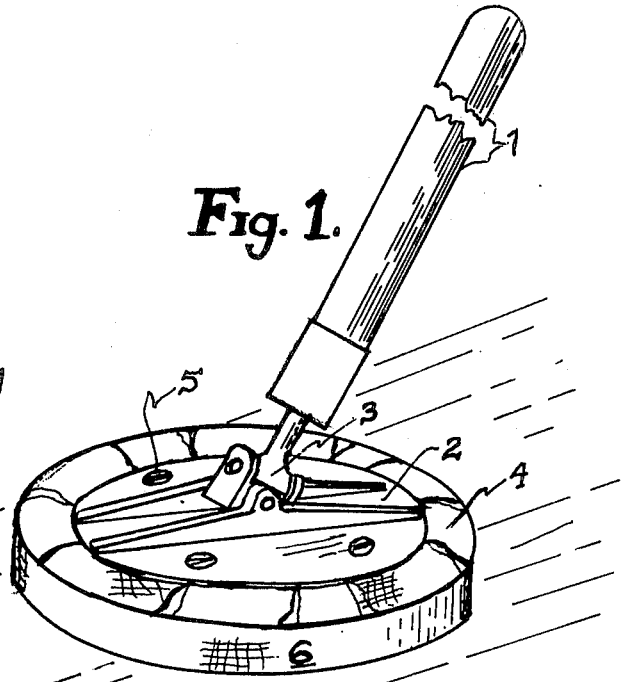
FIG. 1 shows a perspective overall view of a push-broom in accordance with the invention.

Referring now to FIG. 1 the push-broom comprises a handle 1, usually of wood, connected to a sweeping headholder plate 2 by means of swivel joint 3. A sweeping head unit 4 is connected to plate 2 by means of screws 5. The sweeping head is shown as being circular in contour and comprises, in this instance, a wooden disc covered by a cloth 6, preferrably of a long wearing material such as nylon. The swivel joint 3 is designed to be sufficiently free so as to allow the sweeping head 4 to hang in a substantially horizontal plane if the angle of the handle is upward from that plane.

Figure 2:
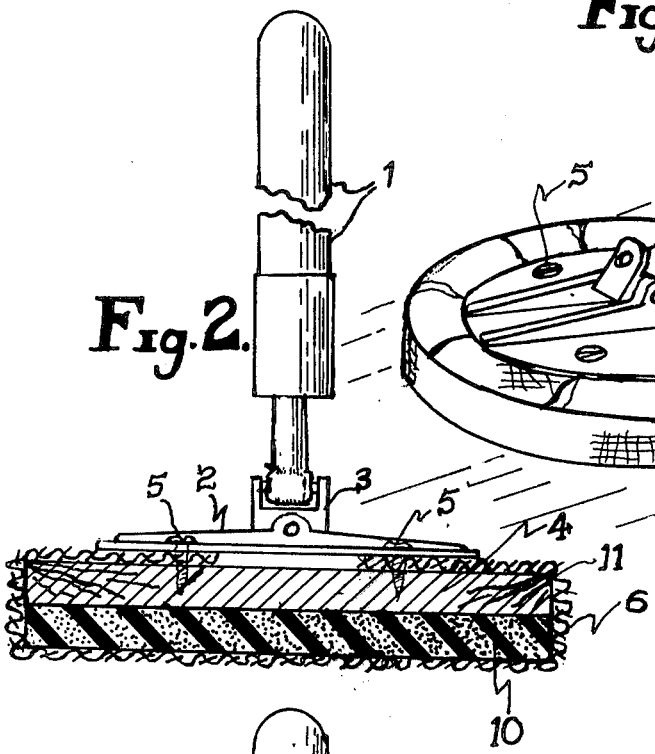
FIG. 2 shows a slightly enlarged, cross sectional, view of the push-broom of FIG. 1 which employs a fabric covered sweeping surface.

FIG. 2 shows, in greater detail, the embodiment of the invention shown in FIG. 1. The swivel joint 3 is constituted by a universal type joint which allows considerable angular movement of the handle with respect to the sweeping head but not relative rotational movement. The advantage of the non-rotational movement is that the rotational orientation of the head can be controlled by the handle, as will be obvious.

The cloth or fabric covering 6 surrounds a wooden head 11 having an underside, in turn, covered by a layer of firm sponge 10. The wooden and rubber parts of the head are wrapped in fabric 6 which is secured thereabout by clamping the free ends between wooden part 11 and plate 2. by means of screws 5.

Figure 3:
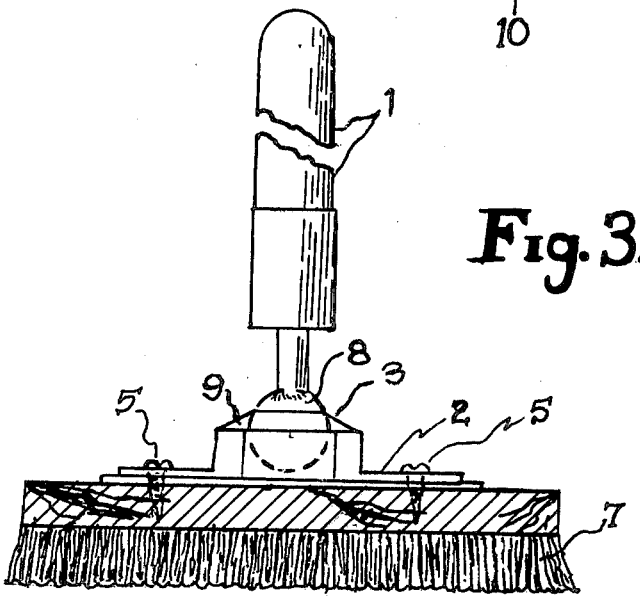
FIG. 3 shows a cross-sectional view of a push-broom in accordance with the invention which employs a bristled sweeping surface.

FIG. 3 shows a further emobodiment of the invention wherein the swivel joint is constituted by a ball 8 and a socket 9 which also allows the handle to be moved about joint 3. However, it has been found that the joint 3 should preferrably be locked against allowing rotational movement between the handle and the head since otherwise the broom can change direction unexpectedly in use with the possiblility of a rock being burned.

The sweeping surface of the broom head of FIG. 3 is provided with relatively short bristles 7, the short bristles have less tendency to bend unevenly and thus a parallel relationship between the broom head and the ice surface is more easily maintained.

Although specific embodiments of the invention have been described it will be obvious modifications may be made which do not depart from the spirit and scope of the present invention. Other types of ice contacting surfaces may be used. For instance the coarseness of the fabric may be varied to provide different types of sweeping action i.e. to allow stronger sweepers to apply their strength more profitably. Different types of bristles may also be used and permanent bending in any one direction effectively nullified by variation of orientation of the head during sweeping action.

I claim:

1. A push broom for the game of ice curling comprising, a rigid sweeping head provided with a planar underside covered with a fabric capable of producing heat of friction when simultaneously pressed against and moved across a sheet of ice, the fabric material being turned up over all sides and the top of the sweeping head, a centrally located plate secured to the top side of the sweeping head and overlying the fabric turned therefore, an elongated rod-like handle secured by means of a universal joint to the symmetrical center of the plate and the sweeping head, the universal joint allowing the handle to assume substantially any angle between 0 degrees and 90 degrees with respect to the plane of the sweeping head while preventing relative rotational movement between the axis of the handle and the axis of the sweeping head perpendicular to the plane thereof.

2. A broom as claimed in claim 1 wherein a thin layer of firm sponge-like material is provided between the sweeping head and the fabric material to allow for minor irregularities in the surface of the ice being sweept.

3. A broom as claimed in claim 1 or 2 wherein the plane of the sweeping head is circular.

* * * * *